United States Patent [19]

Warman

[11] 4,167,159

[45] Sep. 11, 1979

[54] PRESSURIZED LIQUID COOLING SYSTEM FOR AN INTERNAL COMBUSTION ENGINE

[75] Inventor: Bruce L. Warman, Silvis, Ill.

[73] Assignee: Deere & Company, Moline, Ill.

[21] Appl. No.: 792,211

[22] Filed: Apr. 29, 1977

[51] Int. Cl.[2] ..... F01P 7/14

[52] U.S. Cl. ..... 123/41.08; 123/41.54; 123/41.15; 165/107 D

[58] Field of Search ..... 123/41.08, 41.09, 41.1, 123/41.54, 41.15, 41.27; 165/32, 107 D

[56] References Cited

U.S. PATENT DOCUMENTS

| | | | |
|---|---|---|---|
| 1,852,770 | 4/1932 | Duesenberg | 123/41.27 X |
| 2,292,946 | 8/1942 | Karig | 123/41.54 X |
| 2,333,993 | 11/1943 | Frailing | 123/41.54 X |
| 3,132,634 | 5/1964 | Butler | 123/41.54 |
| 3,765,383 | 10/1973 | Birdwell, Sr. | 123/41.54 X |
| 3,809,150 | 5/1974 | Holmes | 123/41.54 X |

*Primary Examiner*—Charles J. Myhre
*Assistant Examiner*—Jeffrey L. Yates

[57] ABSTRACT

A liquid cooling system for an internal combustion engine includes a conventional radiator and circulating system and pressure cap, the latter having pressure and vacuum relief valve components for limiting the maximum operating pressure of the system and for limiting negative pressures to avoid damage during cooling after engine shutdown. A second, temperature responsive, pressure relief valve provides a lower system relief pressure as long as the temperature of the coolant in the radiator top tank remains below a certain level. When that level is exceeded, a thermally actuated valve excludes the second pressure relief valve from the system and maximum operating pressure is then limited, at a higher level by the valving of the pressure cap. In an alternative embodiment, an infinitely variable pressure relief valve responsive to and controlled by changes in coolant temperature replaces the fixed second pressure relief valve and its thermal actuator. As the temperature of the coolant increases, the set point of the variable pressure relief valve also increases and the system relief pressure varies automatically with the coolant temperature over a range of pressures whose upper limit is significantly greater than the set point of the relief valve in the pressure cap so that maximum system operating pressure is still limited by the pressure cap.

33 Claims, 6 Drawing Figures

PRESSURIZED LIQUID COOLING SYSTEM FOR AN INTERNAL COMBUSTION ENGINE

BACKGROUND OF THE INVENTION

This invention relates to liquid cooling systems for internal combustion engines and more particularly to pressurized systems equipped with relief valves for venting the system if predetermined maximum operating pressures are exceeded.

It has long been known to pressurize or increase the maximum operating pressure of a given cooling system as a means of getting an increase in cooling capacity without increasing physical size of the system. An increase of pressure elevates the coolant boiling point in accordance with the well known laws of physics so that higher operating temperatures are possible without undesirable boiling of the coolant or related problems such as circulating pump cavitation and overflow and loss of coolant. With higher temperature differentials between coolant and ambient air at the radiator core, cooling capacity of the system is increased.

In a typical pressurized system, however, only a single relief pressure is provided and this pressure, of course, must be relatively high, consistent with the maximum cooling capacity needed for the most severe operating conditions of the particular engine installation. Further, it is characteristic of such systems that they operate at or near this relatively high relief pressure during most of their operating lives and thus, much of the time, away from an optimum combination of coolant pressure and temperature. The life of cooling system components such as the radiator core, radiator hoses and water pump seals are shortened, comparatively, when subjected frequently to operating cycles with unnecessarily high coolant temperatures and pressures.

Further, although nominally increasing the overall cooling capacity of a given system, increasing its maximum operating or relief pressure may actually have an adverse effect on cooling at certain critical points in the engine, particularly in systems where a significant amount of phase-change cooling occurs. For example, the most efficient cooling occurs at an engine cylinder wall when conditions are such that some phase transformation takes place—that is, when heat from the cylinder wall is sufficient to raise the temperature of the coolant in contact with it to its incipient or nucleate boiling point. An increase in the operating pressure of a given system elevates the coolant boiling point, and the coolant temperature rise at the cylinder wall may then be sufficient to produce these optimum heat transfer conditions only in rarely met extreme operating conditions and, in fact, during normal operation there may be an actual decrease in heat transfer from the cylinder wall to the coolant. The resulting increases in the cylinder wall and piston temperatures and in cylinder peak firing pressures may, for example, lead to early fatigue failures in pistons which are typically made of material which has lower fatigue strength at elevated temperatures. In addition, lubricating oil temperatures are higher and there is an increased rate of oil contamination.

It has also been known to provide cooling systems in which system pressure varies with engine operating conditions in the normal working range, maximum operating pressure being limited by a conventional pressure-cap relief valve. For example, U.S. Pat. No. 3,765,383, Birdwell, discloses a closed cooling system, completely filled with coolant, of a type sometimes called a recovery system. A bellows-like accumulator is provided to accommodate the expansion or "overflow" of coolant from the radiator which may occur as the engine warms up. The expandable accumulator is mechanically restrained in such a way that the rate of increase of system pressure is at first slow but eventually is caused to rise more rapidly as maximum permissible coolant temperatures are approached. Clearly such a variable pressure system has a greater potential for providing heat transfer conditions at critical points closer to optimum over a wider range of operating conditions than a conventional system having only a single maximum operating or relief pressure. However, this is a passive system in which pressure, as a function of temperature, is a dependent variable. The system is without feedback or self-correcting ability, and is dependent upon such factors as careful maintenance of coolant fill level and coolant composition for repeatability of a predetermined pressure/temperature characteristic.

SUMMARY OF THE INVENTION

Accordingly, it is an object of the present invention to provide an improved cooling system and particularly one which offers at least one operating level between the maximum cooling capacity required in the engine application and that of an unpressurized system in the same application. It is a further object of the invention to use means responsive to changes in a selected engine operating parameter to control system pressure consistent with the requirements of efficient engine operation.

It is a feature of the invention to limit maximum operating or relief pressure to a lower level until a higher level is actually needed, thus potentially reducing radiator cost and increasing engine life when compared with a conventional system having only a single maximum operating or relief pressure.

It is another feature of the invention that by providing for more than one level of maximum operating or relief pressure in controlled response to changes in an engine operating parameter such as coolant temperature, it is possible to maintain more nearly optimum heat transfer conditions at critical points in the engine for a greater percentage of operating time. In particular, the boiling point of the coolant is controlled through the control of system pressure and hence it is possible to design the system so that conditions for maximum heat transfer efficiency (where some phase transformation occurs in the coolant) are present over a wider range of engine operating conditions.

It is in keeping with the present invention, to introduce variable supplementary pressure relief means into what might otherwise be a generally conventional cooling system having a conventional pressure cap for limiting system maximum operating pressure to an upper maximum. The additional pressure relief means essentially provide for maximum operating or relief pressures lower than that which might be set for the system by the pressure cap. Alternatively, the variable pressure relief means may replace rather than supplement the conventional pressure cap and provide for the total range of predetermined permissible maximum operating pressures. In either case a transducer responsive to changes in an engine operating parameter such as coolant temperature controls the pressure relief means so as to provide an increase of operating pressure and hence cooling capacity only when engine operating conditions demand, for example when engine temperature increases due to an increase in engine load or in ambient temperature.

An advantage of the invention is that there is active control of system pressure through the feedback provided by a transducer sensing an engine operating parameter—that is to say, pressure is a controlled rather than a dependent variable. The system is at least partially self-correcting with respect to variations in measures of its condition, such as fill level or composition of the coolant which would affect its unmodified pressure/temperature characteristic. There is a certain minimum coolant temperature, which varies with starting conditions (fill level, ambient temperature, etc.), above which the pressure/temperature relationship of the system is repeatably controlled at predetermined desirable levels whenever the engine is run.

DESCRIPTION OF THE PREFERRED EMBODIMENT

The invention is embodied in a power unit, including an internal combustion engine and a liquid cooling system for the engine, of a type which may, for example, be used to drive a mobile machine such as an agricultural tractor or a combine harvester or, as a stationary unit, to drive an irrigation pump.

Figure 1:
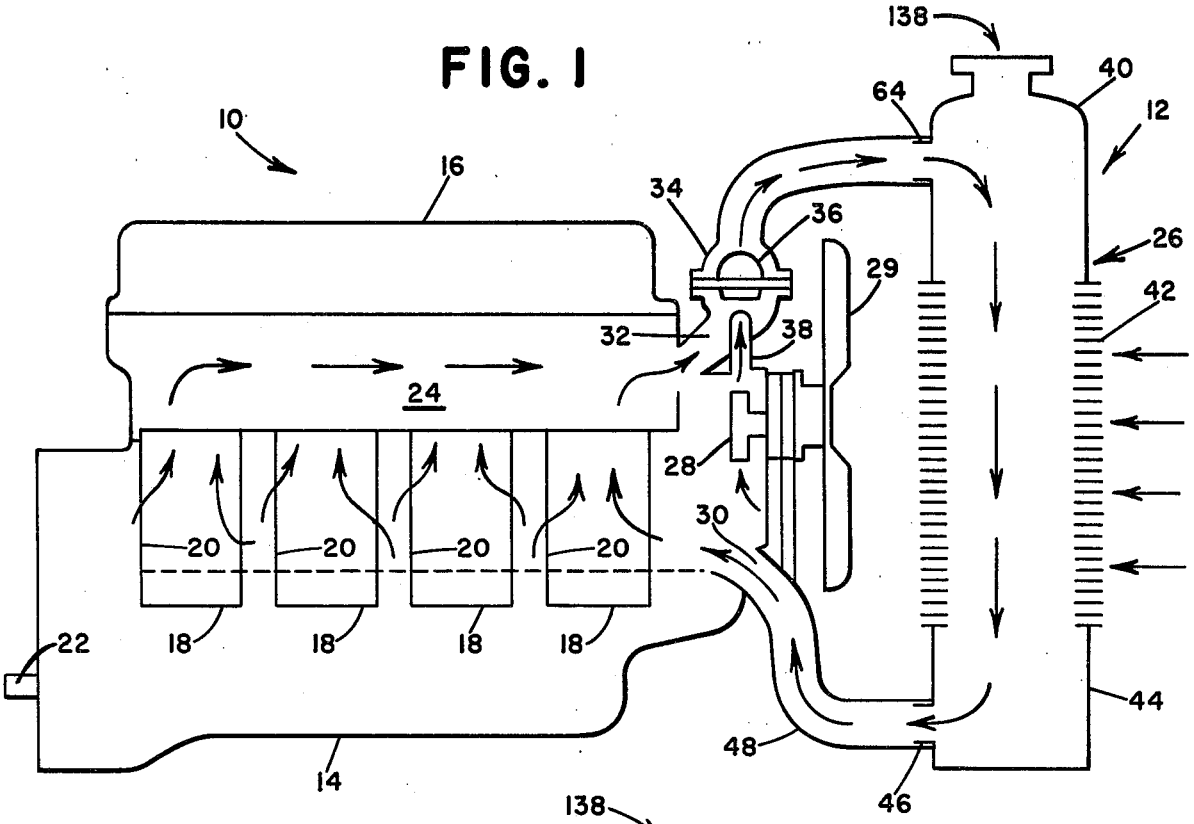
FIG. 1 is a schematic side elevation of a power unit with a cooling system embodying the invention.

The general design and construction of such power units is well known and the principal components of a typical unit are shown semi-schematically in FIG. 1. It includes an internal combustion engine indicated generally by the numeral 10 and a forward mounted cooling system indicated generally by the numeral 12, both mounted on a frame which is not shown. The engine includes a cylinder block 14 forming the main body of the engine and a cylinder head casting 16 mounted on the cylinder block 14. The cylinder block 14 houses four equal cylinders 18, each cylinder being defined by a cylindrical wall 20. Output from the power unit is taken from a horizontal crank shaft 22, only the end of which is shown in FIG. 1.

Principal components of the cooling system are a water jacket 24, a radiator 26, a water pump 28 and fan 29. The water jacket 24 includes connecting passages and chambers (not shown) within the cylinder block and cylinder head casting 14 and 16 to carry coolant to parts of the engine subject to heating during operation, including the cylinder walls 20. In FIG. 1, arrows on the cylinder block 14 and cylinder head 16 indicate generally the extent of the water jacket 24 and, together with other arrows in the figure, show the general direction of circulation of coolant in the system. The water jacket also includes an inlet 30 and an outlet 32, the latter including an enlarged portion 34 housing a thermostat 36. A bypass 38 connects the water jacket outlet 32 on the engine side of the thermostat 36 to the water jacket 24 close to the circulating pump 28.

The radiator 26 comprises a top tank 40, a radiator core 42 and a radiator bottom tank 44. A bottom tank outlet 46 is connected to the water jacket inlet 30 by an inlet hose 48.

Figure 2:
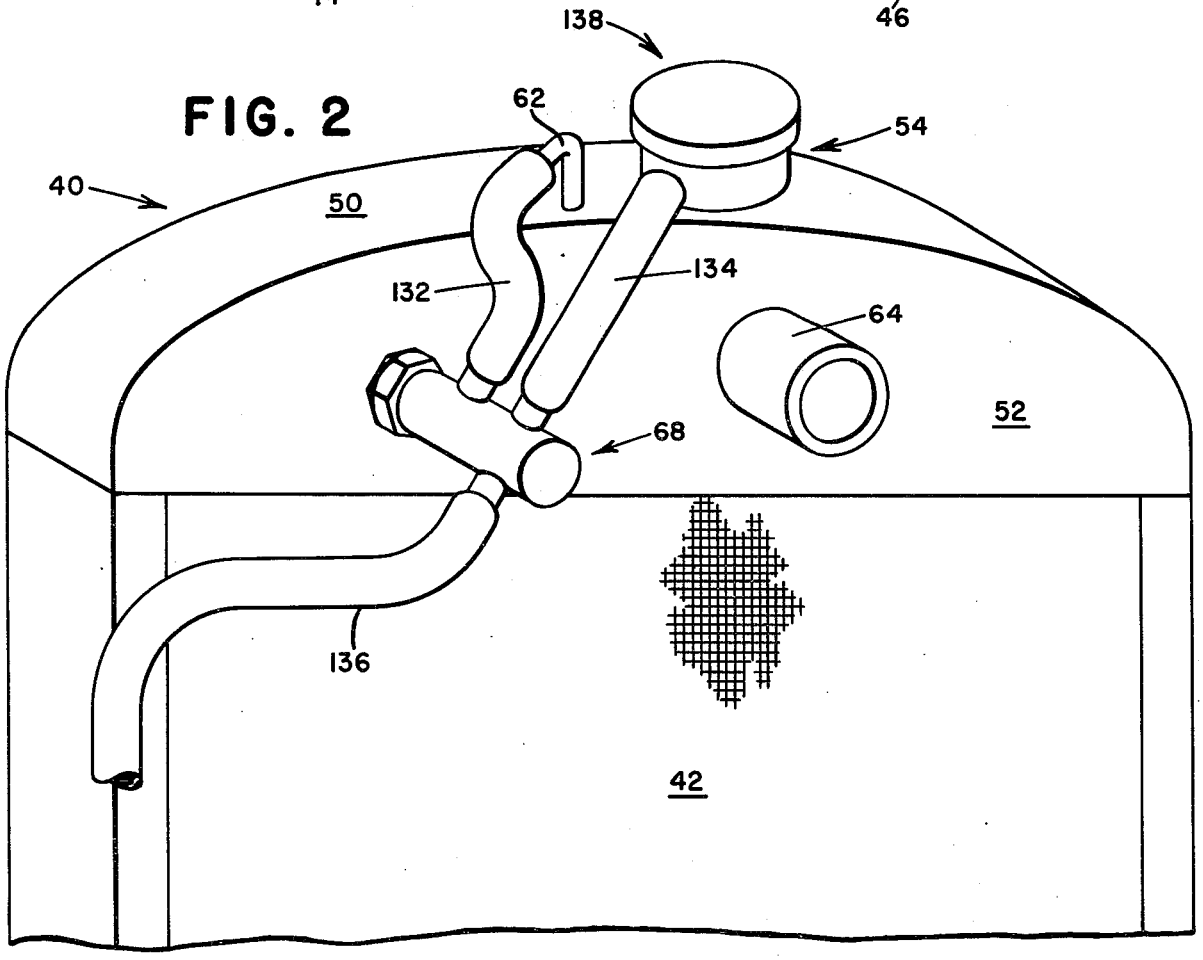
FIG. 2 is an enlarged left hand rear three-quarter view of the upper part of the radiator showing location of the pressure control valves.
Figure 3:
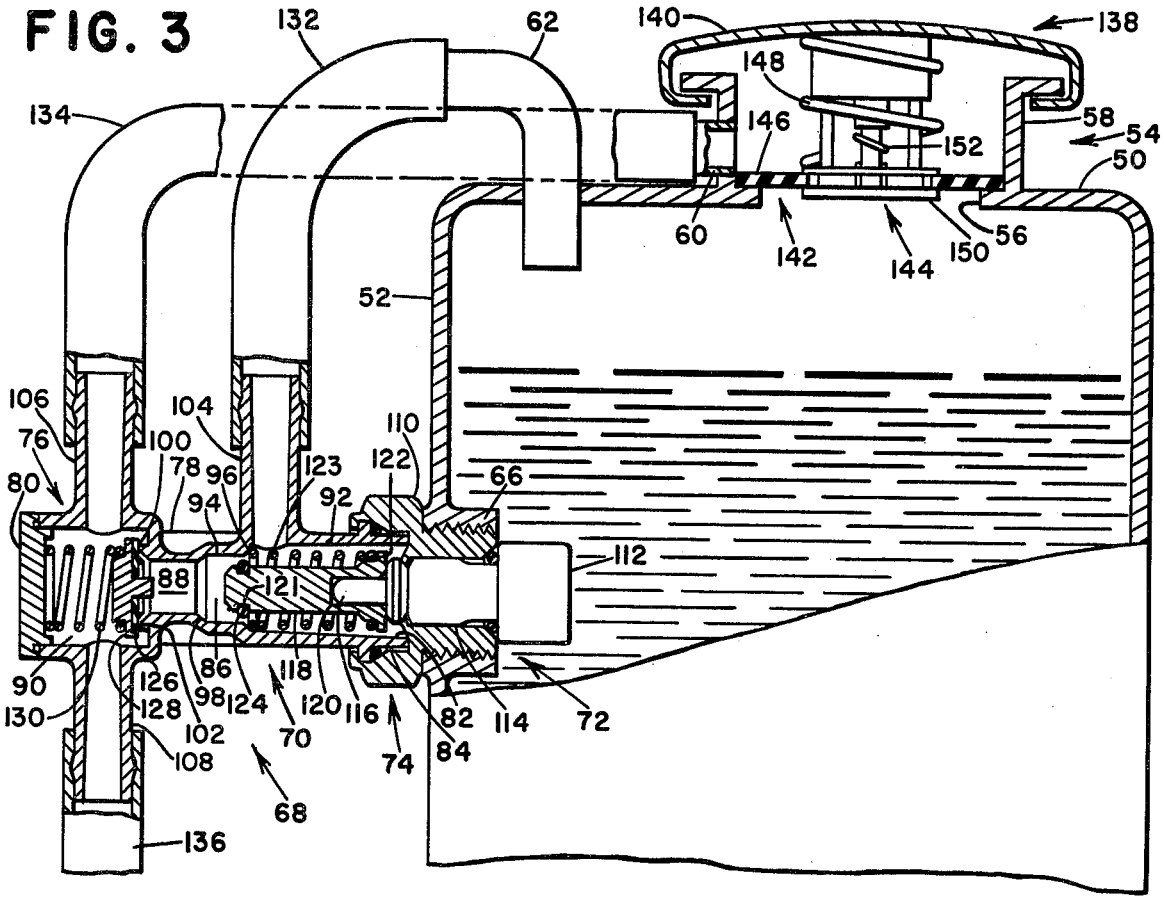
FIG. 3 is a further enlarged semi-schematic right hand cut-away partial view of the radiator top tank showing the pressure control valves in cross-section.

The top tank portion of the cooling system is shown in more detail in FIGS. 2 and 3. The top tank includes top and rear walls 50 and 52, respectively. A filler neck 54 is mounted in an aperture 56 approximately central in the top wall 50 and includes a generally cylindrical filler neck wall 58 which carries a horizontal outlet pipe 60 directed transversely to the left. An elbow connector pipe 62 is mounted in the central portion of the top tank top wall 50 to the left of the filler neck 54 and communicates with the inside of the top tank 40. The top tank rear wall 52 carries a top tank inlet connector 64 generally below the filler neck 54 and to its left an internally threaded valve mounting adapter 66 (best shown in FIG. 3) both communicating with the inside of the top tank 40. A pressure control valve 68 is screwed into the adapter 66 and tightened to make a fluid-tight joint. The valve includes a body 70, a thermoactuator 72, a thermoactuated valve 74 and a relief valve 76. The valve body 70 includes a generally cylindrical central portion 78 with a cap 80 sealing its outer end. The inner end 82 of the body central portion 78 is open and carries a short length of external thread 84. Internally the body central portion 78 is divided into three coaxial, generally cylindrical communicating chambers consisting of an inner chamber 86, a connecting orifice 88 and an outer chamber 90. The inner chamber 86 has a large diameter portion 92 adjacent the open end 82 and an inner smaller diameter portion 94 ending adjacent the orifice 88. At the junction between the chamber portions 92 and 94 is an annular thermoactuator return spring shoulder 96. At the junction between the inner chamber 86 and the orifice 88 is an annular beveled shoulder 98 forming a guide for the thermally actuated valve 74. At the junction of the outer chamber 90 and the orifice 88, a shoulder 100 carries a seat 102 for the relief valve. Extending generally vertically upwards from the body's central portion 78 are a low pressure relief pipe connector 104 communicating with the inner chamber 86 and a high pressure relief pipe connector 106 communicating with the outer chamber 90. Also communicating with the outer chamber 90 is a vent pipe connector 108 extending generally downwards and diametrically opposite the high pressure pipe connector 106.

The thermoactuator 72 includes a body portion 110 which is internally threaded to mate with the external threads 84 at the open end 82 of the pressure control valve body 70. The thermoactuator body 110 also carries external threads mating with those of the valve mounting adapter 66. The body 110 houses and holds rigidly a transducer assembly consisting of a sensing bulb 112 and an actuator portion 114. An actuator pin 116 coaxial with the pressure control valve body portion 70 extends from the actuator 114 into the body inner chamber 86. The transducer is of a known and commercially available type in which temperature changes sensed by the bulb 112 cause fluid pressure changes inside the bulb, an increase of pressure causing the pin 116 to move axially inwards in the chamber 86. A thermoactuator valve stem 118 is piloted on the actuator pin 116 by an internal bore 120 and has an external O-ring groove 121 at its inner end and an annular flange 122 at its outer end. The valve stem 118 is retained on the actuator pin 116 by a thermoactuated valve return spring 123 compressed between the flange 122 of the valve stem 118 and the shoulder 96. An O-ring 124 is carried in the O-ring groove 121 of the valve stem 118. (The thermoactuated valve 74 is normally open as shown in FIG. 3.)

The low pressure relief valve assembly 76 is housed in the outer chamber 90 of the pressure control valve 70 and includes a valve seat washer 126 piloted on a valve guide 128. A valve spring 130 is piloted on the opposite side of valve guide 128 and compressed between the valve guide and the valve body cap 80. (The low pressure relief valve 76 is normally closed as shown in FIG. 3.)

A low pressure relief hose 132 extends between the connector elbow 62 in the top wall of the top tank and the low pressure connector 104 in the pressure control valve 68. A high pressure relief hose 134 extends between the filler neck relief outlet 60 and the high pressure port 106 in the pressure control valve 68. A vent hose 136 is attached to the vent pipe connector 108 and extends downwards to a convenient discharge point (not shown) towards the underside of the power unit.

The top tank 40 is closed and normally sealed by a conventional removable pressure cap 138 retained on the filler neck 54. The pressure cap includes a body 140 and includes relief valve and vacuum valve components 142 and 144, respectively. Included in the valves are relief valve seat and spring 146 and 148, respectively, and vacuum valve seat and spring 150 and 152, respectively. (The relief valve 142 is normally closed as shown in FIG. 3.)

Figure 4:
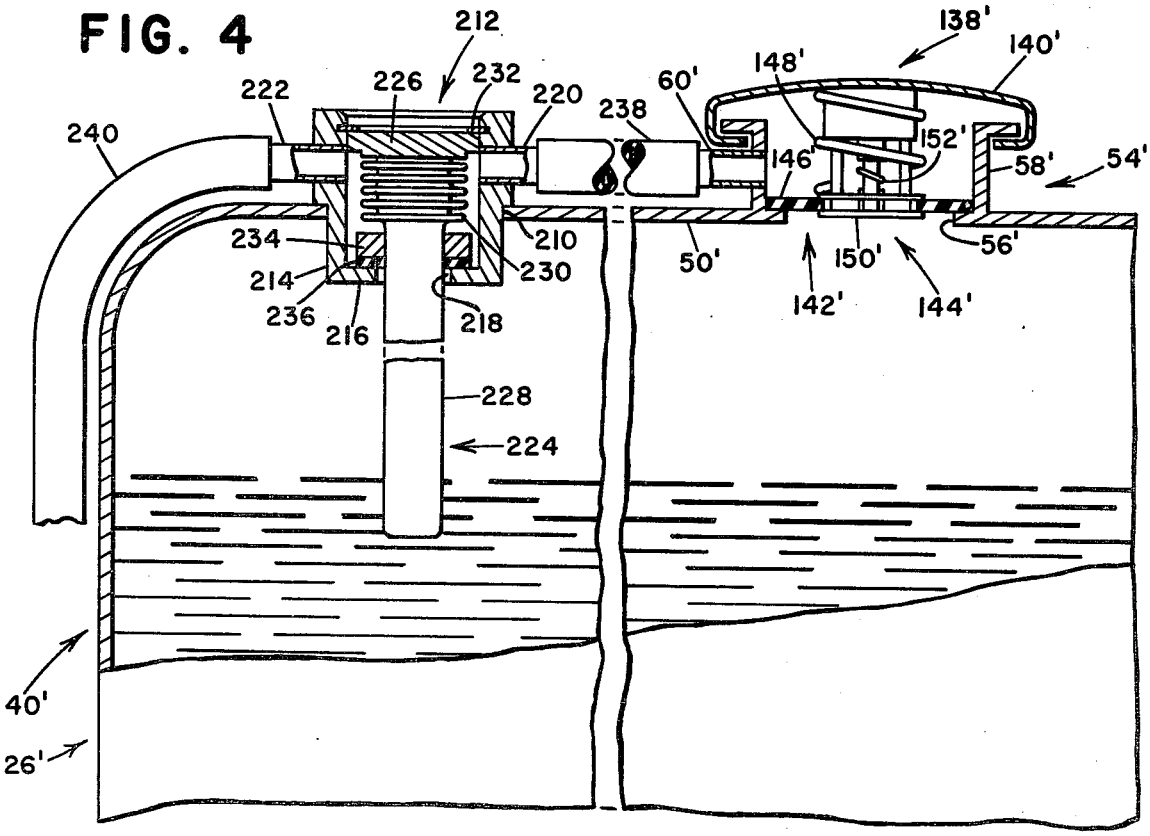
FIG. 4 is a sectional rear view on a generally transverse vertical plane of the top tank portion of a radiator embodying another version of the invention.

A modified embodiment of the invention is shown diagrammatically in FIG. 4 which shows only the top tank (40') portion of the radiator 26', of a cooling system similar to that shown in FIG. 1 and conventional except for the embodiment of a second version of the current invention.

A filler neck 54' is mounted in an aperture 56' in the top tank top wall 50', and includes a generally cylindrical wall portion 58' and a pipe connector 60' communicating with the inside of the filler neck 54' and extending laterally and horizontally above the top wall 50'.

Mounted in another aperture 210 in the top wall 50' to the left of the filler neck 54' is a variable pressure relief valve indicated generally by the numeral 212 and normally closed, as shown in FIG. 4. The valve includes a body having a generally cylindrical wall 214 open at the outer end but with an internal end wall 216, the wall having a central aperture 218. A pipe connector 220 extends horizontally and laterally to the right while an opposite vent pipe connector 222 extends to the left, both connectors communicating with the inside of the valve body through the cylindrical wall 214. A sealed bulb and bellows assembly 224 partially filled with fluid is mounted rigidly on an end cap 226 with the bulb portion 228 extending downwards through the valve body opening 218, the expandable resilient bellows portion 230 wholly within the valve body and the end cap 226 closely fitting the inside of the valve body wall 214 and retained by a snap ring 232. An annular valve collar 234 is attached rigidly to the bulb 228 inside the valve body adjacent the end wall 216. An annular valve seat washer 236 rests against the underside of the valve collar 234. A pressure relief hose 238 connects the filler neck and valve pipe connectors 60' and 220, respectively. A vent hose 240 attached to the vent pipe connector 222 extends generally downward to a convenient discharge point (not shown) towards the underside of the power unit.

The cooling system is again closed with a conventional pressure cap 138' retained on the filler neck 54' and including a body 140' carrying a relief valve 142' comprising a valve seat 146' and spring 148' and also a vacuum relief valve 144' including a valve seat 150' and a valve spring 152'.

Before operation the system is filled with coolant, leaving air space for expansion in the top tank 40 as indicated in FIG. 3, and the pressure cap 138 is replaced, closing the system. The upper maximum pressure relief valve 142, with a set point for example of 15 psi, and first or lower pressure relief valve 76, with a set point for example of 7 psi, are in their normally closed condition while the thermoactuated valve 74 is open so that there is fluid communication between the top tank 40 and the first relief valve 76 via hose 132 and orifice 88. As the engine warms up after a cold start the coolant expands and system pressure rises following the well known laws of physics to the level of the set point (7 psi) first relief valve 76 which opens, venting to atmosphere through hose 136. Thereafter, this valve limits system pressure to 7 psi until the temperature of the coolant in the top tank passes through a predetermined temperature (230° F. for example) in response to a change in engine operating conditions such as engine load or ambient temperature when the fluid in the bulb 112 of the thermoactuated valve, having expanded, causes the actuator 114 to force the actuator pin 116 to the left carrying the valve stem 118 with it so that the O-ring 124 engages the inside of the orifice 88, sealing it and thus interrupting communication between the relief valve 76 and the top tank 40 and rendering the relief valve inoperative. If engine operating conditions cause a further rise in coolant temperature, the system pressure continues to increase, now being limited to the upper maximum operating pressure (15 psi) determined by the setting of the pressure cap valve 142. If the pressure in the top tank exceeds 15 psi, the pressure cap valve opens and the system is vented through the pressure relief hose 134 and vent hose 136 via the pressure control valve outer chamber 90.

When more normal engine operations are resumed, coolant temperature and hence pressure falls and when it is below 15 psi, the pressure cap relief valve 142 closes. When coolant temperature once more falls below 230° F. this lower coolant temperature is sensed by the bulb 112 of the thermoactuated valve 74 and the contraction of the bulb fluid causes the valve actuator 114 to permit the actuator pin 116 carrying the valve stem 118 to be forced to the right under the action of the return spring 122 so that O-ring 124 is withdrawn and the orifice 88 is once more open and the first pressure relief valve 76 once more limits system pressure to 7 psi. After the engine is switched off, cooling and contraction of the coolant may result in negative pressure in the system, in which case the vacuum valve 144 in the pressure cap 138 will open to admit air to recharge the air space of the top tank 40.

In the embodiment shown in FIG. 3 and described above, the relief valve 76 is effectively downstream of the thermoactuated valve 74 in a vent passage including the elbow 62, hose 132, valve body 70 and vent hose 136. It will be understood that in an equally operable arrangement the relief valve 76 could be placed in the vent passage upstream of the thermoactuated valve, for example at or adjacent the connection of the vent passage (elbow 62) to the top tank wall 50.

Considering the version of the invention shown in FIG. 4, the variable pressure relief valve 212 is designed so that it is normally closed even at very low engine temperatures, a combination of the resilience of the bellows 230 and vapor pressure of the fluid in the bulb and bellows assembly 224, tending to expand the bellows, resulting in a downward force on the valve seat 236, holding the valve closed. As the engine, and hence the coolant, warms up fluid in the bulb 228 which is partially immersed in coolant in the top tank 40' expands, thus increasing the downward force on the valve collar 234 and so increasing the relief pressure of the system. The valve thus can function as a relief valve relying on the resilience of the bellows 230 and the compressibility of the vapor in the bulb and bellows system 224 as a spring and has a set point varying in controlled response to coolant temperature. When the valve opens to relieve pressure the system is vented through the body of the valve 212 and vent hose 240.

The pressure/temperature characteristic of the variable pressure relief valve 212 is predetermined by the values chosen for such design variables as ratio of the bellows 230 diameter to the diameter of the orifice 218 in the end wall 216 of the valve body, the type and amount of fluid contained in the bulb and bellows assembly 224 and the effective spring rate of the material of the bellows 230. In a typical application the valve may be designed so that effective relief pressure increases (linearly) with temperature to about 6 psi when a top tank temperature of about 225° F. is reached. This may correspond to the boiling point of the fluid in the bulb and bellows assembly 224 so that above 225° F. effective relief pressure rises very rapidly with only a very small increase of temperature. When the effective relief pressure of the variable relief valve 212 exceeds the setting of the pressure cap valve 142' (15 psi for example), system pressure becomes limited by the pressure cap.

It is clear that additional spring means might be associated with the bellows so as to modify the effective spring rate of the bellows system and so vary the pressure/temperature characteristic of the valve 212. (It is clear also that, if desired, the proportions of the valve could be chosen so that it was normally open below a given temperature, closed at that temperature with an effective relief pressure of 0 psi, and closed with a progressively increasing effective relief pressure above that temperature.)

Figure 5:
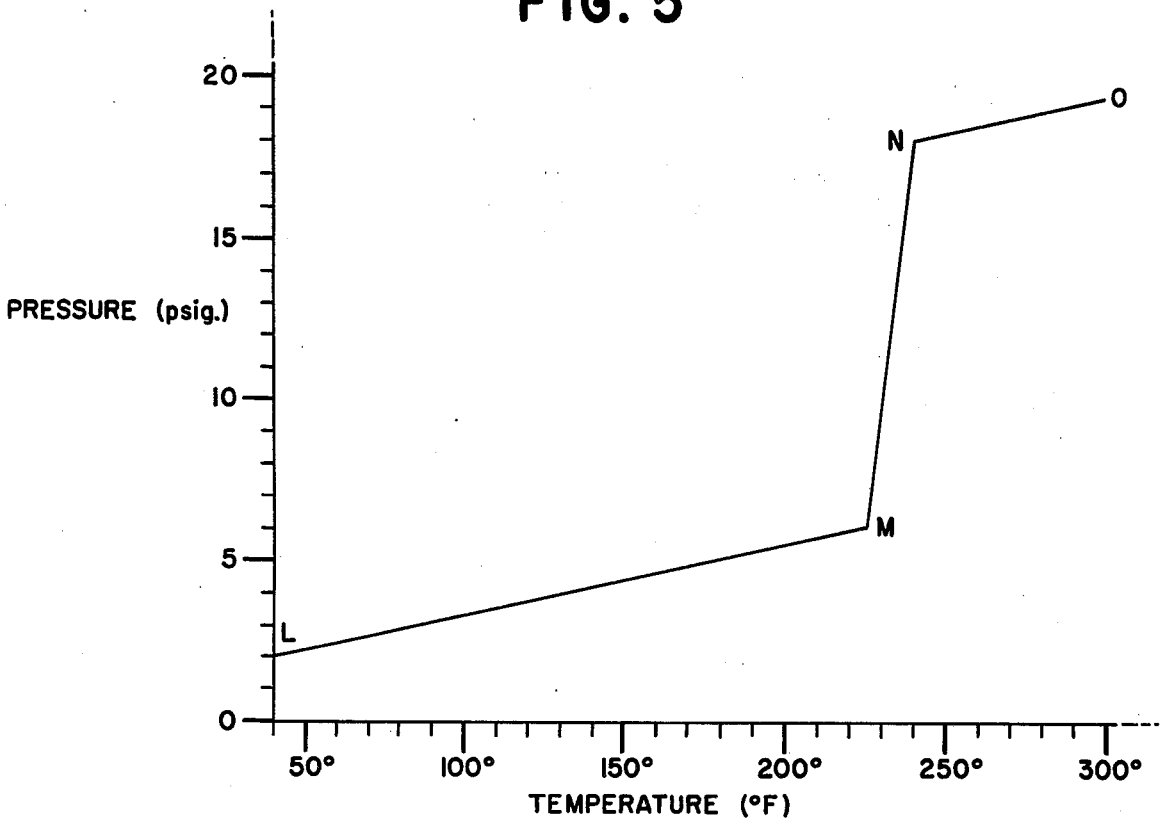
FIG. 5 is a diagram of a typical pressure/temperature characteristic of a variable valve used in the embodiment shown in FIG. 4.

It will be understood also that any variable pressure relief valve with construction similar to the valve 212 described above will have a relief pressure/temperature characteristic similar to that shown in FIG. 5 where the pressure is the effective relief pressure of the valve and the temperature is that of the sensing bulb (similar to bulb 228 above). Referring to FIG. 5, between L and M the effective relief pressure of the valve increases linearly with temperature, but at M the temperature of the bulb is such that a change of state of the fill medium or fluid in the bulb, such as boiling begins and a small increase of bulb temperature results in vaporization of the fluid causing a rapid increase of vapor pressure in the bellows/bulb system and a corresponding rapid increase in effective relief pressure of the valve (MN). At N, all the fill medium in the bulb has been vaporized and further increases in bulb temperature result in only relatively small increases of effective relief pressure, the actual slope of the portion NO of the pressure/temperature characteristic depending on a number of variables as the quantity and nature of the fill medium used. It will be appreciated that a valve of this type could be designed so that the "post vaporization" portion (NO) of the pressure/temperature characteristic provided the desired upper maximum relief pressure for a given cooling system. In particular this would require control of the quantity of the fill medium so that its vaporization was completed at a particular bulb temperature corresponding to a desired top tank temperature in the cooling system. With such a valve in a cooling system an upper maximum pressure relief valve such as the valve 142' embodied in a pressure cap shown in FIG. 4 and described above would not be required.

Figure 6:
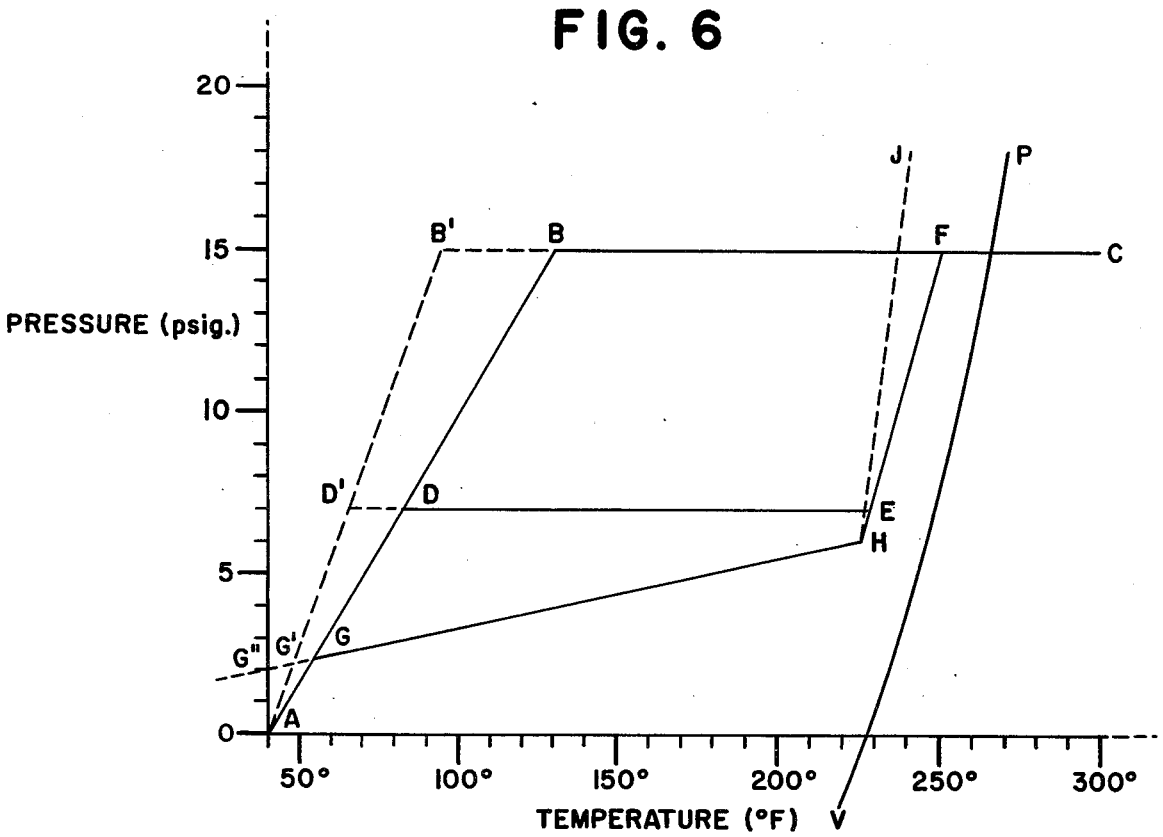
FIG. 6 is a comparative chart showing typical and characteristic relationships between cooling system pressure and top tank temperature for the described embodiments and for a conventional system.

FIG. 6 is a simplified graphical representation of the pressure/temperature characteristics of the cooling system embodiments described above and illustrated particularly in FIGS. 3 and 4. The figure also includes the characteristic for a typical conventional cooling system using only a single pressure relief valve with a fixed set point and also the basic vapor pressure/temperature relationship (VP) for a typical coolant used in such systems. The characteristics shown result from the response of a particular cooling system having given values of the design variables to the well known laws of physics governing the inter-relationship of pressure, volume, and temperature of fluids, and it is assumed there are no extraneous variables such as leakage.

For each system illustrated in FIG. 6 it is assumed for purpose of example that the temperature of the engine and associated cooling system are in equilibrium with an ambient temperature of 40° F. and that the cooling system is at atmospheric pressure (0 psi) when the engine is started. Initially, as the engine begins to warm up and if no relief is provided, system pressure increases linearly with temperature at a rate which will vary somewhat for a given system, the variation depending, for example, on whether the amount of coolant in the system is towards the upper or lower part of a given recommended range of fill. Typical rates of unrelieved pressure increase are indicated by the lines AGDB and A G'D'B'.

In the case of a conventional pressurized cooling system, having a single pressure relief valve with a fixed set point, for example at 15 psi, system pressure increases to B or B' at relatively low top tank temperatures, whereupon the relief valve opens and continues venting limiting the system to 15 psi while top tank temperature continues to increase (BC or B'C).

In the case of a dual pressure or bi-level system as illustrated in FIG. 3, system pressure increases during the initial warm up period to about 7 psi (D or D') after which it remains constant, venting at 7 psi while top tank temperature increases to about 230° F. (D'E or DE). At this temperature the thermoactuated valve 68 closes rendering the 7 psi relief 76 inoperative and further increases of coolant temperature are accompanied by a corresponding increase in cooling system pressure, the pressure/temperature curve (EF) being approximately parallel to the coolant vapor pressure curve (VP). At F, when the top tank temperature is approximately 250° F. the set point (15 psi) of the pressure cap relief valve 142 is reached and any further increases in temperature above 250° result in the system venting at the constant pressure of 15 psi (FC).

An exemplary pressure/temperature characteristic for a system with a variable pressure relief valve such as the valve 212 described above and illustrated in FIG. 4 is shown in FIG. 6 by the lines AG (or G') HFC. At 40° F. the variable pressure relief valve has an effective relief pressure of about 2 psi (G''). As the engine begins to warm up from a cold start at 40° F., system pressure increases according to the characteristics of the cooling system itself to a point such as G or G' where the cooling system temperature and pressure correspond or coincide with points on the line G''H which describes the relief valve characteristic between 40° F. and approximately 225° F. The portion G (or G') H, becomes also the system characteristic, the system controlled by the valve 212 venting at a constantly increasing relief pressure as top tank temperature rises to about 225° F. (at point H). At this temperature, boiling of the fill medium in the bulb and bellows assembly 224 begins and vapor pressure in the bulb and bellows system increases very rapidly so that the effective relief pressure of the valve also increases rapidly for only a small increase of top tank temperature as sensed by the bulb 228 (HJ). Above about 225° F. the effective relief pressure of valve 212 increases rapidly (HJ) than system pressure which follows the line HF. At F, corresponding to a system pressure of about 15 pounds per square inch and a top tank temperature of 250° F., relief valve 142' in the pressure cap 38' opens to vent the system so that further increases in top tank temperature cause no increase in pressure (FC). (Note: HF denotes an unrelieved portion of the pressure/temperature characteristic of the cooling system enclosure itself. Whether or not the corresponding portion (HJ) of the variable valve characteristic has a steeper or lesser slope is a matter of design choice.)

FIG. 6 indicates graphically the potential for designing variable relief pressure cooling systems, according to the present invention, permitting engines to be operated with favorable cooling system conditions for a greater percentage of their total operating time. In general, this means a cooling system pressure/temperature characteristic curve conforming more closely to the vapor pressure curve of the coolant used, and close enough to it that the advantage of localized incipient boiling are obtained, but not so close that the penalties of more general boiling are incurred. As indicated in the above examples, reaching a given top tank coolant temperature at the upper limit of a "normal operating range" can be made the signal to change to a higher maximum operating pressure to condition the cooling system for an increased load demand on the engine and, particularly, for the provision of greater capacity in the cooling system as explained above. The dual pressure system for example (FIG. 3), has been designed so that as coolant temperature in the top tank increases through about 230° F., the maximum operating (relief) pressure is changed from about 7 psi to 15 psi, the increased pressure elevating the boiling point of the coolant, thus postponing boiling in the system, and permitting higher operating temperatures without the previously described adverse effects of boiling, and so making possible greater cooling capacity because of potentially greater temperature differentials between coolant and ambient air at the radiator.

Similarly, with the infinitely variable pressure system illustrated in FIG. 4, higher engine outputs and accompaning increasing coolant temperatures result in progressively increasing maximum operating (relief) pressure in controlled response to a corresponding increase in engine cooling requirement.

In both of these examples of variable relief pressure cooling systems, the system is designed so that as the coolant top tank temperature range corresponding to critical engine operating conditions (about 225° to 250° F.) is approached, the cooling system pressure/temperature curve is deflected upward (EF and HF in FIG. 6) to nearly parallel the vapor pressure curve of the coolant (VP in FIG. 6) and so postpone reaching a generally boiling condition of the coolant, at least until the rare or limiting emergency condition when 15 psi system pressure is exceeded whereupon the upper maximum pressure relief valve opens to vent the system. At this point the pressure/temperature curve is approximately horizontal and any further temperature rise results in coolant boiling and possible loss of coolant through the vent system.

In the exemplary embodiments described here, the engine operating parameter used has been temperature of coolant in the radiator top tank. It will be readily appreciated that any of a number of other parameters related to engine output and operating conditions, such as temperature at other points in the engine (within or outside of the cooling system) or intake manifold pressure may, along with suitable transducers, be used to control cooling system pressure.

I claim:

1. In an internal combustion engine having a plurality of operating parameters and a cooling system including a liquid coolant contained in an enclosure, the fluid pressure in said enclosure varying with coolant temperature, the improvement comprising:

valve means in fluid communication with the enclosure for relieving enclosure pressure when said pressure exceeds a predetermined variable maximum greater than atmospheric and including a first pressure relief valve for limiting enclosure pressure to an upper maximum and a second pressure relief valve for relieving enclosure pressure at a level less than or equal to the upper maximum; and control means operatively associated with the second valve and responsive to at least one engine operating parameter for controlling the second valve so that a given level of the parameter predetermines a given enclosure maximum pressure.

2. The invention defined in claim 1 wherein the control means, cooperating with the second valve, provides an effective relief pressure range, said range having a maximum and a minimum and wherein said maximum is greater than the upper maximum enclosure pressure defined by the first relief valve.

3. The invention defined in claim 1 wherein the control means, responsive to the engine operating parameter and operatively associated with the second pressure relief valve renders said valve inoperative when the engine operating parameter reaches and exceeds a predetermined level so that the enclosure becomes subjectable to the relief pressure of the first valve.

4. The invention defined in claim 3 wherein the second valve is a normally closed relief valve.

5. The invention defined in claim 3 wherein the control means includes means for interrupting fluid communication between the enclosure and the second valve.

6. The invention defined in claim 1 wherein the valve means includes a vent passage providing at least part of the fluid communication with the enclosure and including and being normally closed by the second valve and wherein the control means includes a normally open valve operatively associated with said passage and operable to close said passage in response to a predetermined change in the engine operating parameter so that the enclosure becomes subjectable to the relief pressure of the first valve.

7. In a cooling system for an internal combustion engine, including a liquid coolant contained in an enclosure in which fluid pressure varies with coolant temperature, the improvement comprising:

valve means having fluid communication with the enclosure for relieving enclosure pressure when said pressure equals or exceeds a variable relief pressure greater than atmospheric and including a movable valve element;

passage means providing at least part of the fluid communication of the valve means with the enclosure, said passage means including a valve seat external to the enclosure and said valve element being operable to engage the valve seat and close the passage means; and control means operatively associated with the valve means and responsive to changes in coolant temperature for controlling the valve means so that relief pressure is variable and determined by coolant temperature and including spring means biasing the valve element in the direction of holding the passage means closed against fluid pressure in the enclosure, the spring means including an axially expandable bellows having an internal chamber and the control means further including a sensing bulb, at least partially filled with fluid and in fluid communication with the bellows chamber, the bulb and bellows forming a closed system, the bulb being disposed so as to sense coolant temperature and the bellows being disposed so as to provide at least part of the biasing of the valve element against the valve seat, an increase of coolant temperature causing an increase of fluid pressure in the bulb and bellows system and hence an axial expansion of the bellows and an increase of bias of the valve element against the valve seat and an effective increase in the relief pressure of the cooling system enclosure, said valve seat, valve element and spring means constituting a first normally closed pressure relief valve.

8. The invention defined in claim 7 wherein the bulb and bellows are each generally cylindrical in form, the bellows having opposite end walls including a mounting end and a bulb end, the bulb end having an aperture, and the bulb having an open end and being coaxially and rigidly attached to the bulb end of the bellows, the open end of the bulb registering with the aperture in the end wall of the bellows and providing said fluid communication between the bulb and bellows, and wherein the control means includes mounting means carried by the cooling system, the bulb and bellows assembly being attached to the mounting means by the mounting end of the bellows with the bellows external to the enclosure and the bulb penetrating into the enclosure through the passage means and wherein the valve element is carried by the bulb and disposed so that it normally engages the valve seat.

9. The invention defined in claim 7 wherein the control means cooperating with said first normally closed relief valve of the valve means provides a range of effective relief pressure for the enclosure, said range having a maximum and a minimum and wherein the valve means further includes a second normally closed relief valve having a set point lower than said maximum so that maximum relief pressure for the enclosure is determined by the second relief valve.

10. In a cooling system for an internal combustion engine, including a liquid coolant contained in an enclosure in which fluid pressure varies with coolant temperature, the improvement comprising:

valve means having fluid communication with the enclosure for relieving enclosure pressure when said pressure equals or exceeds a variable relief pressure greater than atmospheric and including first and second normally closed pressure relief valves, the first valve having a set point; and control means operatively associated with the second valve, responsive to changes in coolant temperature and controlling it so as to provide a range of effective relief pressures including a maximum and a minimum, said maximum being higher than the set point of the first valve so that relief pressure is variable and determined by coolant temperature and the maximum relief pressure for the enclosure is determined by the first relief valve.

11. In a cooling system for an internal combustion engine, including a liquid coolant contained in an enclosure in which fluid pressure varies with coolant temperature, the improvement comprising:

valve means having fluid communication with the enclosure for relieving enclosure pressure when said pressure equals or exceeds a variable relief pressure greater than atmospheric and including first and second normally closed pressure relief valves, the set point of the first valve being higher than that of the second; and control means operatively associated with the second valve and responsive to changes in coolant temperature for controlling the valve means so that relief pressure is variable and determined by coolant temperature.

12. The invention defined in claim 11 wherein the fluid communication of the valve means with the enclosure includes a vent passage including and being normally closed by the second relief valve and wherein the control means includes a normally open valve operably responsive to changes in coolant temperature so as to close said vent passage at a predetermined coolant temperature so that the second relief valve is rendered ineffective and the enclosure becomes subjectable to the higher relief pressure of the first relief valve.

13. The invention defined in claim 11 wherein the fluid communication of the valve means with the enclosure includes passage means connected between the enclosure and the second relief valve and the control means includes a thermoactuated valve responsive to coolant temperature operable to block said passage means at a predetermined coolant temperature so that the second relief valve is rendered inoperative and the enclosure becomes subjectable to the higher relief pressure provided by the first relief valve.

14. In a cooling system for an internal combustion engine, including a liquid coolant contained in an enclosure in which fluid pressure varies with coolant temperature, the improvement comprising:

valve means having fluid communication with the enclosure for relieving enclosure pressure when said pressure equals or exceeds a variable relief pressure greater than atmospheric and including a normally closed pressure relief valve operable to relieve pressure in the enclosure and biasable to vary the pressure at which it relieves; and control means operatively associated with the valve means and responsive to changes in coolant temperature for controlling the valve means so that relief pressure is variable and determined by coolant temperature and including an axially expandable bellows having an internal chamber and a sensing bulb, at least partially filled with fluid and in fluid communication with the bellows chamber, the bulb and bellows forming a closed system, the bulb being disposed so as to sense coolant temperature and the bellows being disposed so as to provide at least part of the biasing of the normally closed pressure relief valve, an increase of coolant temperature causing an increase of fluid pressure in the bulb and bellows system and hence an axial expansion of the bellows and an increase of the bias effect of the bellows on the valve.

15. In a cooling system for an internal combustion engine including an enclosure for containing liquid coolant in which fluid pressure varies with coolant temperature, a system for controlling enclosure pressure comprising:

a first relief valve having fluid communication with the enclosure for limiting enclosure pressure to an upper maximum;

a second relief valve having normally open fluid communication with the enclosure for relieving enclosure pressure at a level greater than atmospheric and less than or equal to the upper maximum; and control means responsive to changes in coolant temperature operatively associated with the second relief valve for controlling the second valve so that a given coolant temperature predetermines a given enclosure maximum pressure.

16. The invention defined in claim 15 wherein the control means renders the second relief valve inoperative when the coolant temperature reaches and exceeds a predetermined level so that the enclosure becomes subjectable to the relief pressure of the first relief valve.

17. The invention defined in claim 16 wherein the control means includes means for interrupting fluid communication between the enclosure and the second relief valve.

18. The invention defined in claim 15 wherein the fluid communication of the second relief valve with the enclosure comprises a vent passage including and being normally closed by the second valve and wherein the control means includes a normally open valve operatively associated with said passage and operable to close said passage in response to a predetermined change in coolant temperature so that the enclosure becomes subjectable to the relief pressure of the first relief valve.

19. The invention defined in claim 15 wherein the second relief valve is biasable to provide a variable relief pressure less than or equal to the relief pressure of the first relief valve.

20. The invention defined in claim 19 wherein the control means includes a transducer connected to the engine for receiving energy from the engine in an amount related to changes in coolant temperature and for transforming said energy and means for transmitting said transformed energy to the second relief valve for biasing it so as to provide the variable relief pressure.

21. The invention defined in claim 15 wherein the control means cooperating with the second valve provides an effective relief pressure range, said range having a maximum and a minimum and wherein said maximum is greater than the upper maximum enclosure pressure defined by the first relief valve.

22. In a cooling system for an internal combustion engine including an enclosure for containing a liquid coolant, in which fluid pressure varies with coolant temperature, the improvement comprising:

a first pressure relief valve having fluid communication with the enclosure for relieving enclosure pressure when said pressure equals or exceeds an upper maximum;

a second pressure relief valve having normally open fluid communication with the enclosure for relieving enclosure pressure at pressures greater than atmospheric but less than or equal to the upper maximum; and control means operatively associated with the second relief valve and responsive to changes in coolant temperature for controlling the second valve so that enclosure relief pressure is determined by coolant temperature.

23. The invention defined in claim 22 wherein the fluid communication of the second relief valve with the enclosure comprises a vent passage including and being normally closed by the second relief valve and wherein the control means includes a normally open valve operably responsive to changes in coolant temperature so as to close said vent passage at a predetermined coolant temperature so that the second relief valve is rendered ineffective and the enclosure becomes subjectable to the higher relief pressure of the first relief valve.

24. The invention defined in claim 22 wherein the fluid communication between the second relief valve and the enclosure includes passage means connected between said valve and the enclosure and the control means includes a thermoactuated valve responsive to coolant temperature, and operable to block said passage means at a predetermined coolant temperature so that the second relief valve is rendered inoperative and the enclosure becomes subjectable to the higher relief pressure provided by the first relief valve.

25. The invention defined in claim 22 wherein the second relief valve includes a passage providing at least part of the fluid communication of said valve with the enclosure and including a valve seat external to the enclosure, and relief valve also including a valve element operable to engage the valve seat and close the passage and the control means includes spring means biasing the valve element in the direction of holding the passage closed against fluid pressure in the enclosure.

26. The invention defined in claim 25 wherein the spring means includes an axially expandable bellows having an internal chamber and the control means further includes a sensing bulb at least partially filled with fluid and in fluid communication with the bellows chamber, the bulb and bellows forming a closed system, the bulb being disposed so as to sense coolant temperature and the bellows being disposed so as to provide at least part of the biasing of the valve element against the valve seat, an increase in coolant temperature causing an increase of fluid pressure in the bulb and bellows system and hence an axial expansion of the bellows and an increase in bias of the valve element against the valve seat and an increase in the effective relief pressure of the second relief valve.

27. The invention defined in claim 26 wherein the bulb and bellows are each generally cylindrical in form, the bellows having opposite end walls including a mounting end and a bulb end, the bulb end having an aperture and the bulb having an open end and being coaxially and rigidly attached to the bulb end of the bellows, the open end of the bulb registering with the aperture in the end wall of the bellows and providing said fluid communication between the bulb and bellows and wherein the control means further includes mounting means carried by the cooling system, the bulb and bellows assembly being attached to the mounting means by the mounting end of the bellows with the bellows external to the enclosure and the bulb penetrating into the enclosure through the passage and wherein the valve element is carried by the bulb and disposed so that it normally engages the valve seat.

28. The invention defined in claim 26 wherein the control means cooperating with the second relief valve provides a range of effective relief pressure for the enclosure, said range having a maximum and a minimum and wherein the set point of the first relief valve is lower than said maximum so that maximum relief pressure for the enclosure is determined by the first relief valve.

29. The invention defined in claim 22 wherein the first pressure relief valve has a set point at which it relieves pressure in the enclosure and the control means controls the second relief valve so as to provide a range of effective relief pressures including a maximum and a minimum, said maximum being higher than the set point of the first pressure relief valve so that the maximum relief pressure for the enclosure is determined by the first relief valve.

30. The invention defined in claim 22 wherein the second pressure relief valve is biasable to vary the pressure at which it relieves and wherein the control means includes an axially expandable bellows having an internal chamber and a sensing bulb at least partially filled with fluid and in fluid communication with the bellows chamber, the bulb and bellows forming a closed system, the bulb being disposed so as to sense coolant temperature and the bellows being disposed so as provide at least part of the biasing of the valve, an increase of coolant temperature causing an increase of fluid pressure in the bulb and bellows system and hence an axial expansion of the bellows and an increase of the bias effect of the bellows on the valve.

31. In a cooling system for an internal combustion engine including an enclosure for containing liquid coolant in which fluid pressure varies with coolant temperature, a system for controlling enclosure pressure comprising:

a first relief valve having fluid communication with the enclosure for limiting enclosure pressure to an upper maximum;

a vent passage connected to the enclosure;

a second relief valve included in the vent passage and having normally open fluid communication with the enclosure for relieving enclosure pressure through the vent passage at a level greater than atmospheric and less than or equal to the upper maximum pressure; and control means responsive to changes in coolant temperature operatively associated with the second relief valve for controlling the second valve so that a given coolant temperature predetermines a given enclosure maximum pressure.

32. The invention defined in claim 31 wherein the control means includes a normally open thermoactuated valve included in the vent passage, responsive to coolant temperature and operable to block said vent passage at a predetermined coolant temperature so that the second relief valve is rendered inoperative and the enclosure becomes subjectable to the higher pressure provided by the first relief valve.

33. The invention defined in claim 32 wherein the thermoactuated valve is disposed in the vent passage between the second relief valve and the enclosure.

* * * * *